United States Patent [19]

Ruchel

[11] 4,238,249

[45] Dec. 9, 1980

[54] PROCESS FOR THE PREPARATION OF A COPPER-ZINC MATERIAL

[75] Inventor: Peter Ruchel, Lauf, Fed. Rep. of Germany

[73] Assignee: Diehl GmbH & Co., Nuremberg, Fed. Rep. of Germany

[21] Appl. No.: 970,379

[22] Filed: Dec. 18, 1978

[30] Foreign Application Priority Data

Dec. 30, 1977 [DE] Fed. Rep. of Germany ..... 2758822

[51] Int. Cl.[3] ..... C22F 1/08

[52] U.S. Cl. ..... 148/2; 148/11.5 C; 148/12.7 C

[58] Field of Search ..... 148/2, 11.5 C, 12.7 C, 148/160; 75/157.5

[56] References Cited

U.S. PATENT DOCUMENTS

| | | | |
|---|---|---|---|
| 2,145,065 | 1/1939 | Vaders | 148/160 |
| 2,676,123 | 4/1954 | Gregory | 148/11.5 C |
| 3,046,166 | 7/1962 | Hartmann | 148/11.5 C |
| 3,253,910 | 5/1966 | Burghoff et al. | 75/157.5 |
| 3,774,431 | 11/1973 | Strömblad et al. | 148/11.5 C |
| 3,841,921 | 10/1974 | Shapiro et al. | 148/12.7 C |
| 3,963,526 | 6/1976 | Lunn | 75/157.5 |

FOREIGN PATENT DOCUMENTS

| | | | |
|---|---|---|---|
| 1285561 | 8/1972 | United Kingdom | 148/11.5 R |

*Primary Examiner*—L. Dewayne Rutledge
*Assistant Examiner*—Peter K. Skiff
*Attorney, Agent, or Firm*—Scully, Scott, Murphy & Presser

[57] ABSTRACT

A process for the preparation of a copper-zinc material consists of setting out with an alloy having a theoretical copper content of 61 to 65%, preferably 62% by weight, with the remainder being zinc and common impurities. This alloy is initially cast and, if necessary, subjected to an $\alpha$ stabilizing annealing. After subsequent cold working in one or a few operative steps with a degree of deformation of at least 70%, the alloy is subjected to a heat treatment so as to lead to a $\beta_1$ precipitation and recrystallization. The alloy then evidences a structure in which the recrystallized phases $\alpha$ and $\beta_1$ are present as a discrete fine mixture. Thereafter, the alloy can be again cold worked and annealed.

13 Claims, No Drawings

PROCESS FOR THE PREPARATION OF A COPPER-ZINC MATERIAL

BACKGROUND OF THE INVENTION

1. Field of the Invention

The present invention relates to a process for the preparation of a copper-zinc material having a small grain size, and is related to U.S. patent application Ser. No. 941,131 for Brass Material And A Process For The Preparation Thereof, filed Aug. 11, 1978 by the present inventor and commonly assigned herewith.

2. Discussion of the Prior Art

A process of this type has already become known from U.S. Pat. No. 2,676,123. In this known process, an alloy containing 5 to 40% by weight of zinc, with the remainder being copper as well as impurities, is initially cast and worked in a suitable manner, if need be, with intermediate annealing. The alloy is then annealed at 500° to 600° C. and thereafter cold worked without intermediate annealing. A final annealing at temperatures of about 375° C. should be carried out for so long until the alloy is completely recrystallized whereby the grain size lies above 5 μm.

This known process provides for a material which, due to its relatively fine-grained structure and its therefrom resultant mechanical properties, is well suited for specialized further processing applications, among which there is also the further cold working. Thus, this material can be plastically deformed with good results. Nevertheless, the structure of this known material is still not sufficiently fine-grained to also allow for superplastic deformations which are connected with extraordinarily extensive elongations. Furthermore, the fine-grain quality of the known material is still not adequate to afford the mechanical strength, fatigue strength, as well as corrosion resistance, at least with respect to most types of corrosives, required for many fields of application.

Additionally thereto, the material prepared in accordance with the known process, in the predominant range of the given alloy composition, namely at 5 to about 37% by weight of zinc, is present as a single-phase structure, in this case as an α phase. This α structure tends towards grain coarsening, particularly at temperature increases. This is also the reason due to which the carrying out of the known process is relatively problematic in actual practice. Even a minute exceeding of the annealing period can, in this instance, lead to a significant coarsening of the grain and as a result to an impairment in the mechanical properties.

SUMMARY OF THE INVENTION

Accordingly, it is an object of the present invention to provide a process for the preparation of a copper-zinc material having an especially fine-grained structure. Thereby, on the one hand, the attainment of the fine-grained structure should be as non-critical as possible with regard to the exact maintenance of the annealing time periods, on the other hand, this structure, even during an eventual further processing of the material, should be as stable as possible against temperature increases.

The foregoing object is achieved through the utilization of a process for the preparation of a copper-zinc material having a small grain size which is characterized in that there is initially cast an alloy with a theoretical copper content of 61 to 65%, preferably about 62% by weight, with the remainder zinc and common impurities; thereafter subjected to an α stabilizing annealing at a temperature of between 450° and 700° C. and an annealing period of between 15 minutes and 100 hours; then is cold worked by means of a process which facilitates the application of high degrees of cold working in one or a few operative steps at a degree of deformation of at least 70%, preferably above 85% and subsequently subjected to a heat treatment at temperatures of between 200° and 350° C., preferably between 250° and 300° C., and an annealing period of between one minute and 500 hours, preferably between one and eight hours, so as to lead to a $\beta_1$ precipitation and recrystallization whereby the cooper-zinc material evidences a structure in which the recrystallized phases α and $\beta_1$ are primarily present as a fine mixture in which the component of the $\beta_1$ phase consists of 10 to 50%, preferably about 30 to 40% and this phase is arranged in the form of discrete particles in the grain boundaries of the α phase.

The inventive process permits for the preparation of a copper-zinc material which renders available a uniform grain size of 5 μm or smaller. Due to this extremely fine-grained structure, a so-called microduplex structure, the thus prepared material is almost ideally extensively cold workable and it is possible to achieve extraordinarily high values with respect to hardness and strength. As a result of its almost unrestricted shaping capability, this material is concurrently particularly well suited for additional shaping treatments.

The inventive process also is distinguished through a surprisingly small number of operative steps, as well as by the fact that no hot working steps are required in its implementation. In the copper-zinc material prepared in accordance with the inventive process, the $\beta_1$ phase is embedded in a cohesive matrix of α solid solution subdivided through grain boundaries. Since due to the structure of this matrix the two phases are mutually inhibiting to grain growth, for example, during heating, this structure is particularly stable at an exceeding of the annealing period during its preparation, as well as with respect to temperature increases during subsequent treatments. The last-mentioned is particularly advantageous during an eventual further treatment by means of such working steps which are carried out at elevated temperatures, for instance, such as superplastic deformations.

The invention thus imparts the teaching that the alloy, from which there is prepared the copper-zinc material, must evidence a theoretical copper content of 61 to 65% by weight. Within this alloy range, the binary copper-zinc material possesses a maximum solubility of the $\beta/\beta_1$ phase is the α solid solution and, in the effectuation of the precipitation and recrystallization annealing pursuant to the invention and under the assumption of a precedent cold working of at least 70%, that this will lead to a precipitation of the $\beta_1$ phase out of the α solid solution. Due to this extremely fine dispersion of the $\beta_1$ phase within the α mother phase, after completed recrystallization there is produced the superfine two-phase structure having a less than 5 μm grain size and, at the preferred treatment conditions, having a grain size of below 2 μm.

Within the alloying range indicated by the invention there exists the possibility that the alloy evidences a solely α structure already after the casting due to its composition. In this instance the α stabilizing annealing can be omitted and the cold working can be carried out immediately subsequent to the casting so that the number of the necessary process steps are reduced still further. The preferred embodiment of the inventive process contemplates that this cold working is carried out by means of hydrostatic extrusion. Hereby, on the one hand, it is possible that the entire cold working is effectuated in a single operative step, on the other hand, workpieces can be produced of a size in this manner, which renders them suitable for a wide range of applications.

As a result of the heat treatment which is necessary for the $\beta_1$ precipitation and recrystallization, a portion of the material hardness which is obtained by the extensive cold working is again lost, but concurrently there is achieved a considerably higher soft temper strength than in previously known brass alloys. Insofar as is attempted to obtain a material of greater hardness, a renewed cold working is possible subsequent to the precipitation and recrystallization annealing whereby the strength increases more rapidly than in normal structures. Hereby, the degree of deformation directs itself according to the desired final hardness. Due to the extremely fine-grained structure and the therefrom resultant excellent cold workability, in this finishing cold working it is possible to obtain degrees of deformation of above 99% without the occurrence of a noticeable material brittleness.

However, it is also possible that with this finishing cold working there be included one or more intermediate annealings without this leading to any significant increase in the grain size.

In an embodiment of the inventive process, the alloy can contain a lead additive with an alloying component of up to about 3% by weight for the improvement of the machineability of the alloy. The lead is hereby introduced in the form of isolated particles into the microduplex structure.

Furthermore, the alloy can have a nickel additive of up to 5% by weight introduced therein. This additive, in a known manner, has a recrystallization inhibitive effect and herewith leads to the formation of a particularly fine-grained structure as well as to a further improvement in the processability and the strength of the material which is prepared by means of the inventive process. For the same purpose it is also possible to introduce up to 0.1% by weight of zirconium, silver, niobium or vanadium, or also other similarly recrystallization inhibiting additives in proportions of up to 0.1% by weight of the alloy. Furthermore, the alloy can also contain additives of up to about 0.1% by weight of arsenic, antimony or phosphorus, respectively, a combination of these elements which, in a known manner, protect the $\alpha$ phase from dezincification.

DETAILED DESCRIPTION

Described hereinbelow is now the inventive process for the preparation of a copper-zinc material.

The process proceeds from an alloy having a theoretical copper content of 61 to 65%, preferably about 62% by weight, with the remainder being zinc and common impurities.

The theoretical copper content hereby is that copper content which appears to indicate an alloy with third components, such as impurities and additives, when the $\alpha/\beta_1$ ratio of the alloy at an equilibrium condition nearly equals the $\alpha\beta_1$ ratio of an alloy which is constituted exclusively of copper and zinc.

The required true copper content for the achieving of a sought after structure, in essence, the required theoretical copper content, can be calculated by means of known coefficients. Thus, in accordance with effect and the presence of third components, the true copper content can lie within the indicated range for the theoretical copper content, as well as therebelow and thereabove.

The alloy with the above-indicated composition is initially cast by means of a suitable casting process, for example, continuous casting. Insofar as after the casting of the alloy, due to its composition, does not evidence a pure $\alpha$ structure, directly subsequent to the casting there is effected an $\alpha$ stabilizing annealing. This is carried out at temperatures of between 450° and 700° C., preferably at about 500° C., and for an annealing period of between 15 minutes at 700° C. and about 100 hours at 450° C. It is important that, in each instance, the alloy is present in the $\alpha$ phase prior to the commencement of the cold working sequence and no longer contains a $\beta$ phase.

The cold working is then carried out by means of a process which is suitable to the application of high degrees of cold working in the least possible number of treatment steps. Preferred hereby is cold working through the intermediary of hydrostatic extrusion presses, however, it is possible to contemplate other processes such as conventional extrusion presses, reciprocating mills, pilgrim mills, or swaging mills. The degree of deformation which is to be applied hereby consists of at least 70%, preferably more than 85%. The degree of cold working hereby concurrently forms the measure for the intensity of the subsequent heat treatment which is to effect the precipitation of the $\beta_1$ phase as well as the recrystallization of the structure.

At a precedent cold working of about 90%, the recrystallization is completed after an annealing period of 4 hours at an annealing temperature of 275° C. The alloy is now present as a superfine two-phase structure having a uniform grain size of 1 to 2 $\mu$m.

For example, it is now possible to subject the material at temperatures of up to 350° C. to a superplastic deformation whereby, due to the good temperature stability of the microduplex structure, this will not lead to a significant grain coarsening. The superfine grain permits that, with low working forces, there can be attained relatively extensive deformations, also into complicated shapes.

On the other hand, if there should be set a definite material hardness, for example, in the utilization of the copper-zinc material for the manufacture of screws or springs, then the material prepared pursuant to the inventive process can now also be again cold worked.

In order to realize shapes which are difficult to produce by means of a finishing cold working, for example, through deep drawing, this can also be interrupted by one or more intermediate annealings. The annealing temperature which is to be applied herein in order to achieve the necessary material softening, lies with the material produced by the inventive process at about 275° C., clearly below the usual soft annealing temperatures of about 500° C., at a somewhat lengthier annealing period. Thereby it is thus possible that the microduplex structure is maintained during the entire deep drawing process, as to be able to also avoid a subsequent quenching becoming necessary, under circumstances, at higher annealing temperatures.

Finally, the inventive process is hereinbelow elucidated on the basis of an exemplary embodiment.

EXAMPLE

An alloy having 61% by weight of copper, 2% by weight of lead, 0.03% by weight of arsenic, the remainder zinc and impurities, is cast in a continuous casting wherein the structure evidences about 15% $\beta$ phase after the casting.

Thereafter, the material is annealed for 48 hours at 500° C. so that only the $\alpha$ phase remains present and then, after cleaning of the surface by means of machining extended through a lubricated conical die at room temperature from a 70 mm diameter to a 25 mm diameter. The extruded rod is subsequently subjected for 8 hours to an annealing at 275° C. and thereafter evidences a microduplex structure having a uniform grain size of 1 to 2 $\mu$m.

What is claimed is:

1. A process for the preparation of a copper-zinc material having a small grain size, comprising the steps of:

(a) initially casting an alloy having a theoretical copper content of 61 to 65% by weight, with the remainder being zinc and common impurities;

(b) subjecting said alloy to an $\alpha$ stabilizing annealing at a temperature of between 450° and 700° C. and for an annealing period of between 15 minutes and 100 hours to totally dissolve all of the $\beta$ phase;

(c) cold working said alloy through a process facilitating the application of high degrees of cold working in one or a few operative steps with a degree of deformation of at least 70%; and (d) subjecting said alloy to a heat treatment at temperatures of between 200° and 350° C. and for an annealing period of between 1 minute and 500 hours so as to lead to $\beta_1$ precipitation and recrystallization whereby the copper-zinc material evidences a structure in which the recrystallized phases $\alpha$and $\beta_1$ are primarily present as a fine mixture in which the component of the $\beta_1$ phase consists of 10 to 50% and all of this phase is arranged in the form of a superfine distribution of discrete particles in the grain boundaries of the $\alpha$ phase.

2. Process as claimed in claim 1, comprising adding an additive to said alloy of up to 0.1% by weight of one or more of the elements selected from the group consisting of arsenic, antimony and phosphorus.

3. Process as claimed in claim 1, said alloy having a theoretical copper content of about 62% by weight, with the remainder being zinc and common impurities.

4. Process as claimed in claim 1, wherein said alloy is cold worked to a degree of deformation of over 85%.

5. Process as claimed in claim 1, wherein said heat treatment is imparted to said alloy at temperatures of between 250° and 300° C. and for an annealing period of between 1 and 8 hours.

6. Process as claimed in claim 1, wherein said $\beta_1$ phase component is present in an amount of about 30 to 40%.

7. Process as claimed in claim 1, said cold working being effected through the intermediary of hydrostatic extrusion.

8. Process as claimed in claim 1, comprising further cold working said alloy subsequent to the precipitation and recrystallization annealing.

9. Process as claimed in claim 8, comprising effecting said further cold working with an intermediate annealing at a temperature of 200° to 350° C. and for an annealing period of between 1 minute to 500 hours.

10. Process as claimed in claim 1, comprising a lead additive of up to 3% by weight being included in said alloy.

11. Process as claimed in claim 1, comprising a nickel additive of up to 5% by weight being included in said alloy.

12. Process as claimed in claim 1, comprising adding an additive to said alloy of up to 1% by weight of one or more of the elements selected from the group consisting of zirconium, silver, niobium, and vanadium.

13. Process as claimed in claim 9, comprising adding an additive to said alloy of up to about 0.1% by weight of one or more of the elements selected from the group consisting of zirconium, silver, niobium, and vanadium.

* * * * *